US012253294B2

(12) United States Patent
Cui et al.

(10) Patent No.: US 12,253,294 B2
(45) Date of Patent: Mar. 18, 2025

(54) REFRIGERATOR

(71) Applicants: SHENYANG HAIER REFRIGERATOR CO., LTD., Liaoning (CN); QINGDAO HAIER REFRIGERATOR CO., LTD., Shandong (CN); HAIER SMART HOME CO., LTD., Shandong (CN)

(72) Inventors: Zhanpeng Cui, Shandong (CN); Jiaming Li, Shandong (CN); Peng Lyu, Shandong (CN); Lisheng Ji, Shandong (CN)

(73) Assignees: SHENYANG HAIER REFRIGERATOR CO., LTD., Liaoning (CN); QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 89 days.

(21) Appl. No.: 18/025,432

(22) PCT Filed: Aug. 31, 2021

(86) PCT No.: PCT/CN2021/115640
§ 371 (c)(1),
(2) Date: Mar. 9, 2023

(87) PCT Pub. No.: WO2022/057616
PCT Pub. Date: Mar. 24, 2022

(65) Prior Publication Data

US 2023/0324101 A1 Oct. 12, 2023

(30) Foreign Application Priority Data

Sep. 15, 2020 (CN) ..... 202010968834.7

(51) Int. Cl.
*F25D 17/08* (2006.01)
*F25D 17/06* (2006.01)
*F25D 23/02* (2006.01)

(52) U.S. Cl.
CPC ..... *F25D 17/062* (2013.01); *F25D 17/08* (2013.01); *F25D 23/028* (2013.01)

(58) Field of Classification Search
CPC ..... F25D 17/062; F25D 17/08; F25D 23/028
USPC ..... 312/405
See application file for complete search history.

(56) References Cited

U.S. PATENT DOCUMENTS 2,745,259 A * 5/1956 Saunders ..... F25D 23/025 62/518
5,996,370 A * 12/1999 Lee ..... F25D 17/062 62/DIG. 13

(Continued)

FOREIGN PATENT DOCUMENTS

CN 104457102 A 3/2015
CN 105444489 A 3/2016

(Continued)

OTHER PUBLICATIONS

Chinese Intellectual Property Office (ISR/CN), "International Search Report for PCT/CN2021/115640", China, Nov. 15, 2021.
EPO, "Supplementary European Search Report for EP Application No. 21868443.9", Hague, Germany, Dec. 5, 2023.

*Primary Examiner* — James O Hansen
(74) *Attorney, Agent, or Firm* — troutman pepper locke; Tim Tingkang Xia, Esq.

(57) ABSTRACT

A refrigerator, comprising a refrigerator body and a door body. The front side of the refrigerator body is open to define a first chamber. The door body comprises a main door and a secondary door, wherein the main door is used for opening or closing the first chamber and defining a second chamber; and the secondary door is used for opening or closing the (Continued)

second chamber. A rear wall of the main door is of a hollow structure to define an air duct, and a plurality of air diffusion micro-holes in communication with the second chamber and the air duct are backwards formed in a front surface of the rear wall. In addition, the refrigerator is configured such that cold air created by the refrigerator is introduced through the air duct, and the cold air enters the second chamber through the plurality of air diffusion micro-holes.

10 Claims, 4 Drawing Sheets

(56) References Cited

U.S. PATENT DOCUMENTS

| | | | | |
|---|---|---|---|---|
| 2015/0323237 | A1* | 11/2015 | Kim | F25C 1/00 62/340 |
| 2016/0025402 | A1* | 1/2016 | Ahn | F25D 17/065 62/419 |
| 2017/0234603 | A1* | 8/2017 | Basso | F25D 23/04 454/183 |
| 2018/0238600 | A1 | 8/2018 | Lee et al. | |

FOREIGN PATENT DOCUMENTS

| | | | | |
|---|---|---|---|---|
| CN | 106679291 | A | 5/2017 | |
| CN | 212378328 | U | 1/2021 | |
| KR | 20160045316 | A | 4/2016 | |
| WO | WO 2004059228 | * | 7/2004 | F25D 23/02 |

* cited by examiner

REFRIGERATOR

CROSS-REFERENCE TO RELATED PATENT APPLICATION

This application is a U.S. national stage application of PCT Patent Application No. PCT/CN2021/115640 filed Aug. 31, 2021, which claims priority to and the benefit of Chinese Application No. 202010968834.7 filed Sep. 15, 2020, which are incorporated herein in their entireties by reference.

FIELD OF THE INVENTION

The present invention relates to the technical field of refrigeration and freezing, and in particular to a refrigerator.

BACKGROUND OF THE INVENTION

With the advancement of technology and the improvement of people's living standards, users have higher and higher requirements for refrigerators. The traditional refrigerators with only a refrigerating room, a freezing room and a temperature-variable room can no longer meet users' diverse needs for storage space.

In recent years, a composite door body technology has emerged in the field of refrigerators. As is well-known to all, a traditional refrigerator door body is used to open and close a refrigeration chamber of a refrigerator body. At most, a bottle holder is disposed at an inner lining of the refrigerator door body for placing bottled articles. As for the refrigerator with the composite door body, the structure and functions of the door body are improved, which makes the door body include a main door and a secondary door, and enables the main door to be used for opening and closing the refrigeration chamber. In addition, the main door defines a door body chamber with an open front side, and the secondary door is used to open and close the door body chamber. The secondary door remains closed during rotation of the main door. The door body chamber can be used for placement of stored articles, and only the secondary door needs to be opened when taking and placing the stored articles, without opening the main door. It not only makes the operation more convenient and faster, but also avoids excessive cold energy loss caused by frequent opening of the main door.

However, the refrigerator with the composite door also has many defects. For example, the space of the door body chamber is too small, so that the temperature is not easy to control, and the problems of larger temperature fluctuation and uneven temperature everywhere are prone to occurring. Moreover, the phenomenon of condensation often occurs on inner walls of the door body chamber. These problems will have a negative impact on user experience and hinder the further development of the composite door technology.

BRIEF DESCRIPTION OF THE INVENTION

An object of the present invention is to solve at least one of the above-mentioned defects existing in the prior art, and to provide a refrigerator that makes the temperature throughout a door body chamber more uniform.

Another object of the present invention is to reduce the temperature fluctuation in the door body chamber.

A further aspect of the present invention is to effectively remove condensed dew on inner walls of the door body chamber.

In particular, the present invention provides a refrigerator, including a refrigerator body and a door body, where a front side of the refrigerator body is open to define a first chamber; the door body includes a main door and a secondary door; the main door is used for opening and closing the first chamber and defining a second chamber, and the secondary door is used for opening and closing the second chamber;

a rear wall of the main door is of a hollow structure to define an air duct, and a plurality of air diffusion micro-holes communicated with the second chamber and the air duct are backwards formed in a front surface of the rear wall; and the refrigerator is configured such that cold air produced by the refrigerator is introduced through the air duct, and is allowed to enter the second chamber through the plurality of air diffusion micro-holes.

Optionally, an air inlet of the air duct faces the first chamber to introduce cold air in the first chamber.

Optionally, the rear wall is also provided with an air return port communicated with the first chamber and the second chamber to allow air in the second chamber to return to the first chamber through the air return port.

Optionally, the air inlet and the air return port are located at a top and a bottom of the rear wall, respectively.

Optionally, the refrigerator further includes a fan, installed at the air inlet to promote the air in the first chamber to flow into the air duct.

Optionally, the refrigerator further includes:

a temperature sensor, used for detecting the temperature of the second chamber; and a controller, used for receiving a detection signal of the temperature sensor, and controlling a running state of the fan according to the temperature of the second chamber.

Optionally, the temperature sensor is installed on a top surface of the second chamber.

Optionally, the arrangement density of the air diffusion micro-holes gradually decreases in a direction from top to bottom.

Optionally, the plurality of air diffusion micro-holes have a plurality of different air outlet directions.

Optionally, the plurality of air diffusion micro-holes are all circular and arranged in a matrix.

The refrigerator provided by the present invention is a refrigerator with a composite door. The door body includes the main door and the secondary door, where the main door is used for opening and closing the first chamber defined by the refrigerator body, and the secondary door is used for opening and closing the second chamber defined by the main door. The present invention makes the temperature fluctuation in the second chamber smaller and the temperature throughout the second chamber more uniform by means of a special design of an air supply structure of the second chamber, thus improving the user experience. According to the present invention, the rear wall of the main door is of the hollow structure to define the air duct, and the plurality of air diffusion micro-holes communicated with the second chamber and the air duct are backwards formed in the front surface (i.e., a rear wall face of the second chamber) of the rear wall of the main door. The cold air produced by the refrigerator is introduced through the air duct, and is allowed to enter the second chamber through the plurality of air diffusion micro-holes. The present invention supplies air to the second chamber through the plurality of air diffusion micro-holes, and air supply points are numerous and wide in distribution range, so that all parts of the second chamber can be directly covered by the cold air, and the temperature of all the parts is more uniform. In addition, even if some of the air diffusion micro-holes are blocked by stored articles, the other air diffusion micro-holes can continue to supply air, which makes the refrigeration process of the second chamber not affected by the blockage of the stored articles.

The refrigerator provided by the present invention uses the air duct to supply air to the second chamber, and can control the flow rate of the air duct by detecting the temperature of the second chamber in real time, so that the temperature of the second chamber is more accurately maintained at a set level, and the temperature fluctuation is accordingly reduced.

Further, since the rear wall of the main door directly faces the first chamber, the temperature of the rear wall is lower than those of other parts of the main door, and condensation is more likely to occur. According to the refrigerator provided by the present invention, the air is supplied to the second chamber through the air diffusion micro-holes, so that there is a stronger air flow flowing near the rear wall of the main door, the flowing of the air flow will inhibit the condensation process on the front surface of the rear wall of the main door, and it is difficult to generate condensed dew. Furthermore, the relative humidity of the air flow entering the second chamber from the air duct is inevitably lower than that of the original air flow at the front surface of the rear wall of the main door (the relative humidity of the air near the condensed dew is inevitably very high), so the introduction of the low-humidity air of the air duct can promote the evaporation of the condensed dew. In addition, since the plurality of air diffusion micro-holes are formed in the front surface of the rear wall of the main door, the surface area of a physical part of the rear wall is significantly smaller and scattered by the air diffusion micro-holes, which is even more unfavorable for the generation and retention of the condensed dew.

Further, according to the refrigerator provided by the present invention, it is more convenient and simpler in structure to make the air duct introduce the cold air from the first chamber. Moreover, the rear wall of the main door is provided with the air return port, and the air inlet and the air return port are further located at the top and bottom of the rear wall, respectively, so that a smoother air path circulation can be formed.

Further, according to the refrigerator provided by the present invention, by installing the fan at the air inlet, the forced circulation of the air flow can be realized by means of the fan, so that the refrigeration speed of the second chamber is accelerated. Furthermore, the temperature sensor is also used to detect the temperature of the second chamber, and the controller can control the running state of the fan (that is, the starting, stopping and running time of the fan) according to the temperature of the second chamber, so as to adjust the air volume of the air duct; and therefore, the refrigerating capacity of the second chamber is finally adjusted.

Further, the arrangement density of the air diffusion micro-holes is specially designed in the present invention. In the direction from top to bottom, the arrangement density of the air diffusion micro-holes is gradually reduced, so that the air volume in a space at an upper side of the second chamber is larger, which compensates for the influence of the relatively high temperature of the upper side of the second chamber caused by hot air floating upward, and further makes the temperature throughout the second chamber more uniform.

Further, according to the refrigerator provided by the present invention, the plurality of air diffusion micro-holes have the plurality of different air outlet directions, so that the overall air supply of the rear wall of the main door is more dispersed, to make the temperature of all the parts of the second chamber more uniform.

The above and other objectives, advantages, and features of the present invention will be better understood by those skilled in the art according to the following detailed description of specific embodiments of the present invention in conjunction with the accompanying drawings.

BRIEF DESCRIPTION OF THE DRAWINGS

In the following part, some specific embodiments of the present invention will be described in detail in an exemplary rather than limited manner with reference to the accompanying drawings. The same reference numerals in the accompanying drawings indicate the same or similar components or parts. Those skilled in the art should understand that these accompanying drawings are not necessarily drawn to scale. In the drawings.

DETAILED DESCRIPTION

A refrigerator according to an embodiment of the present invention will be described below with reference to FIGS. 1 to 4. The orientations or positional relationships indicated by "front," "rear," "upper," "lower," "top," "bottom," "inside," "outside," "transverse," etc. are based on the orientations or positional relationships shown in the accompanying drawings, only for the convenience of describing the present invention and simplifying the description, rather than indicating or implying that a device or an element referred to must has a particular orientation, and be constructed and operated in a particular orientation, and therefore cannot be construed as a limitation of the present invention.

Figure 1:
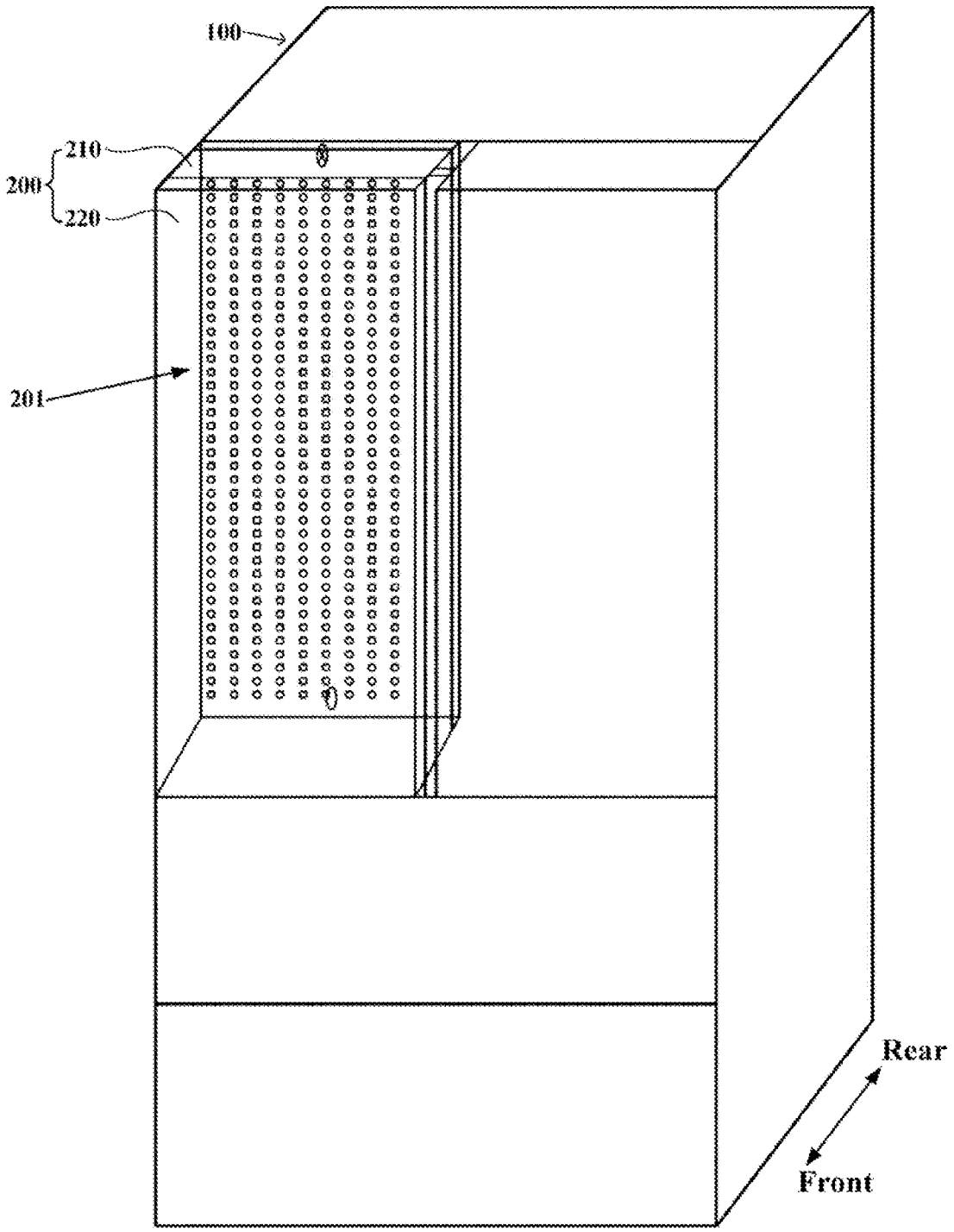
FIG. 1 is a schematic diagram of a structure of a refrigerator according to an embodiment of the present invention.
Figure 2:
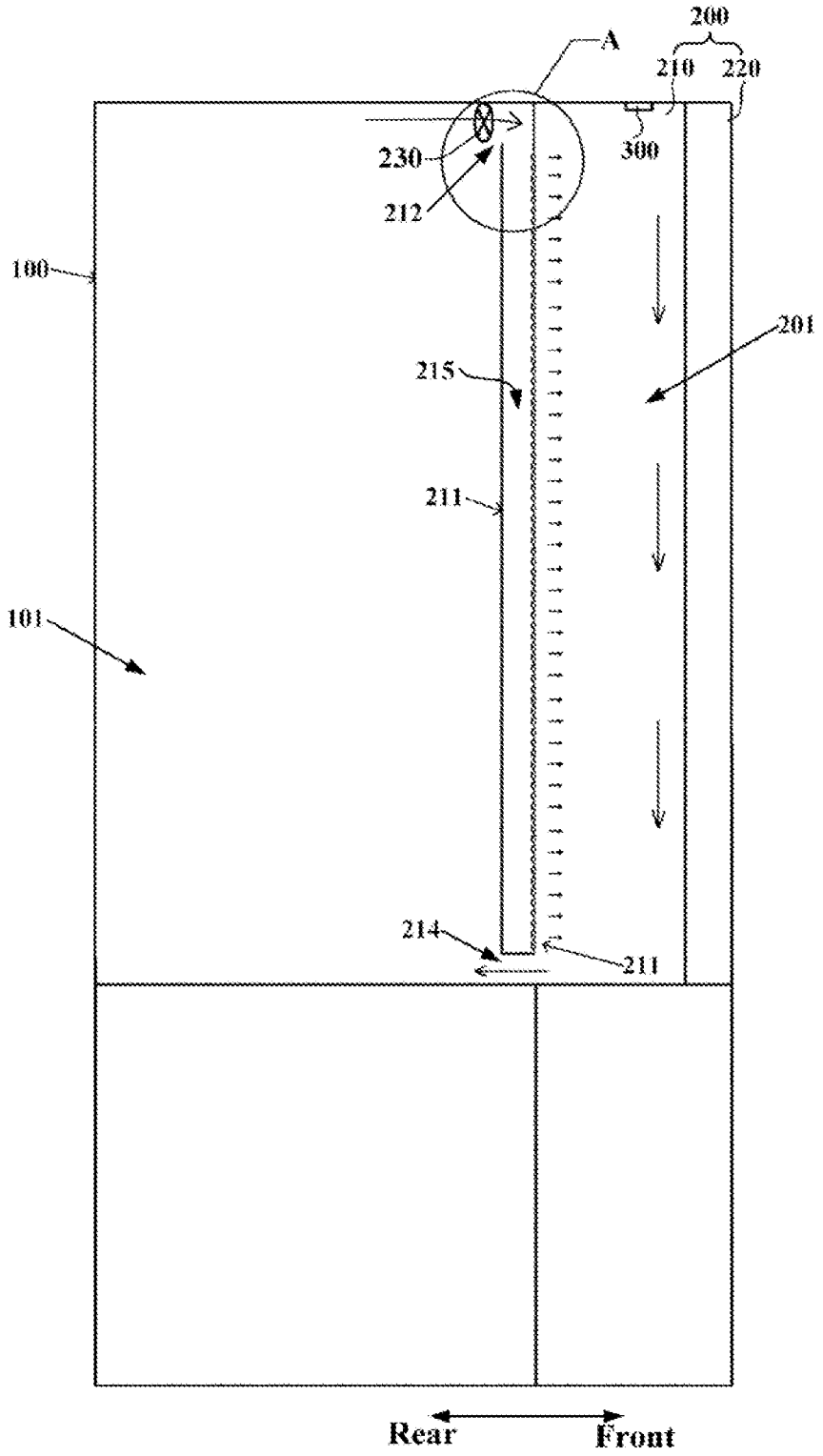
FIG. 2 is a schematic diagram of an air path circulation of the refrigerator shown in FIG. 1.
Figure 3:
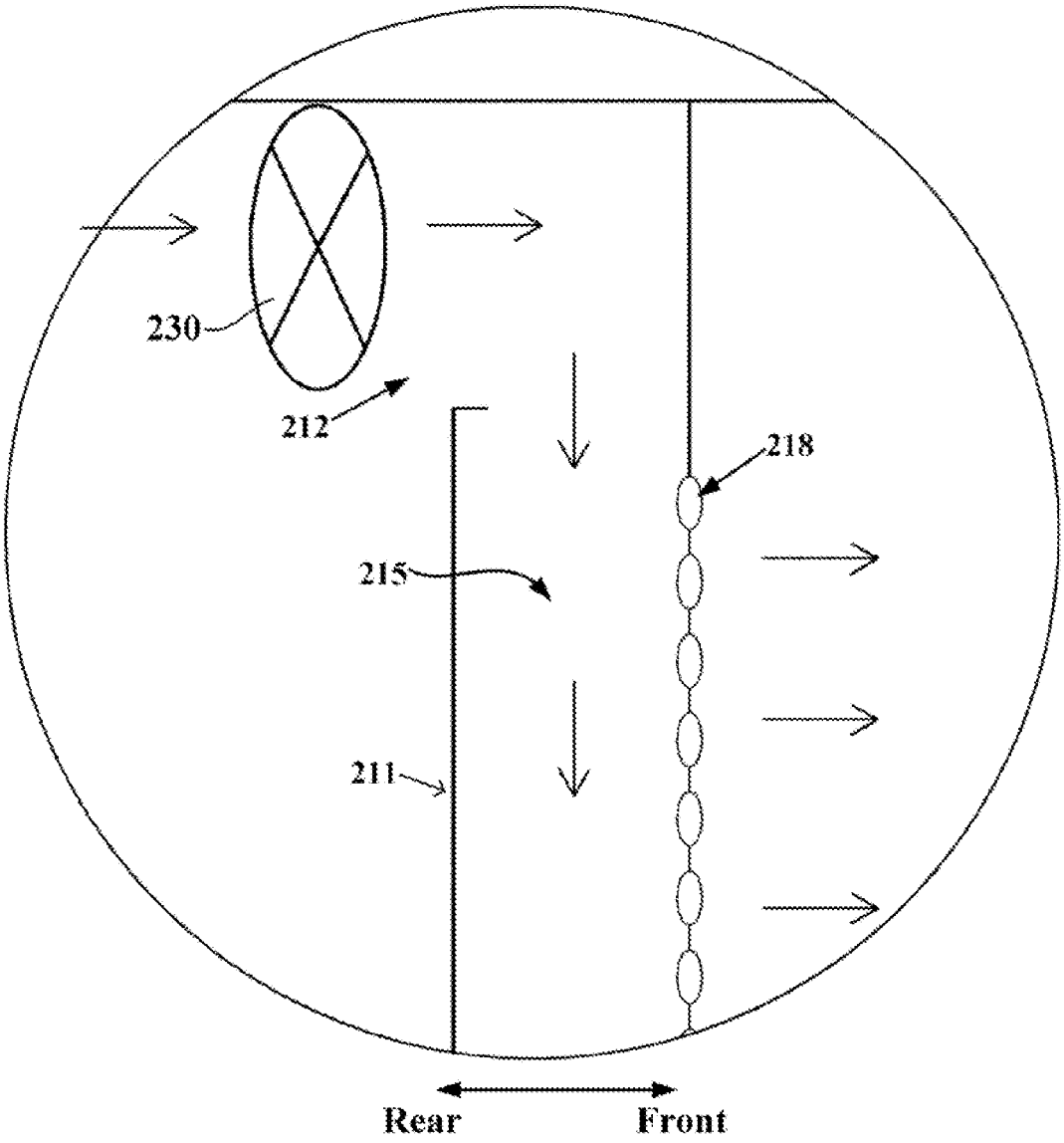
FIG. 3 is an enlarged view at A in FIG. 2.
Figure 4:
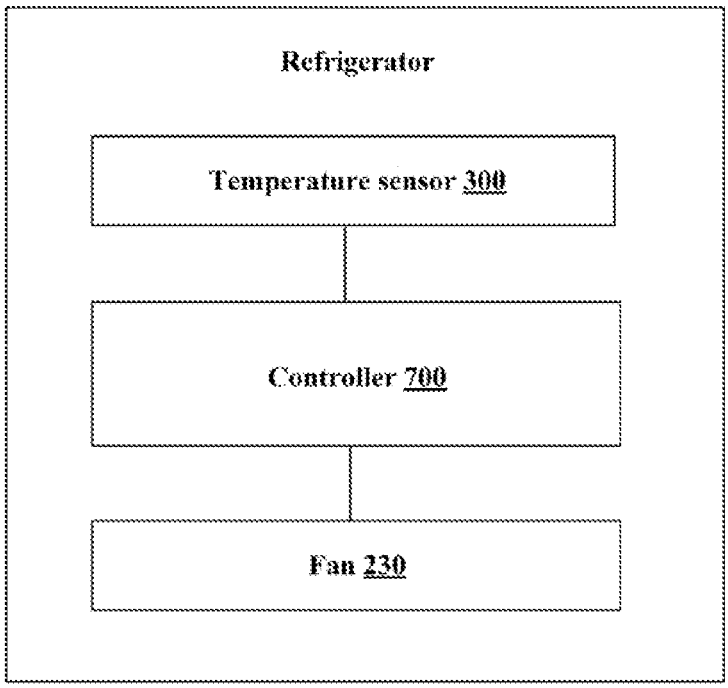
FIG. 4 is a schematic block diagram of a refrigerator according to an embodiment of the present invention.

FIG. 1 is a schematic diagram of a structure of a refrigerator according to an embodiment of the present invention; FIG. 2 is a schematic diagram of an air path circulation of the refrigerator shown in FIG. 1, and the air directions are indicated by arrows in the figures; FIG. 3 is an enlarged view at A in FIG. 2; and FIG. 4 is a schematic block diagram of a refrigerator according to an embodiment of the present invention.

As shown in FIGS. 1 to 4, the refrigerator according to the embodiment of the present invention may generally include a refrigerator body 100 and a door body 200, where a front side (the side where the door body 200 is located is used as the front side of the refrigerator provided by the present invention, and the front and rear directions have been shown in the figures) of the refrigerator body 100 is open to define a first chamber 101. The door body 200 includes a main door 210 and a secondary door 220, where the main door 210 is used for opening and closing the first chamber 101, and defining a second chamber 201, and the secondary door 220 is used for opening and closing the second chamber 201.

The main door 210 can be rotatably installed on the refrigerator body 100 at the front side of the refrigerator body 100, a front side of the main door 210 is open to define the aforementioned second chamber 201, and the secondary door 220 can be rotatably installed on the main body 210 at the front side of the main door 210. When the main door 210 is opened, a user accesses articles from the first chamber 101. When the main door 210 is closed and the secondary door 220 is opened, the user can access articles from the second chamber 201.

As shown in FIGS. 2 and 3, according to the refrigerator provided by the present invention, a rear wall 211 of the main door 210 is of a hollow structure to define an air duct 215. A plurality of air diffusion micro-holes 218 communicated with the second chamber 201 and the air duct 215 are backwards formed in a front surface of the rear wall 211. Furthermore, the refrigerator is configured such that cold air produced by the refrigerator is introduced through the air duct 215, and is allowed to enter the second chamber 201 through the plurality of air diffusion micro-holes 218.

The refrigerator can be refrigerated by a vapor compression refrigeration cycle system, a semiconductor refrigeration system or other means. According to different refrigeration temperatures, all chambers inside the refrigerator can be divided into a refrigerating room, a freezing room and a temperature-variable room. For example, the temperature in the refrigerating room is generally controlled within a range of 2° C. to 10° C., preferably 4° C. to 7° C. The temperature range in the freezing room is generally controlled at −22° C. to −14° C. The temperature-variable room can be adjusted within a temperature range of −18° C. to 8° C. to achieve a variable temperature effect. Different types of articles are different in optimal storage temperatures and storage chambers suitable for storage. For example, fruit and vegetable foods are suitable for storage in the refrigerating room, and meat foods are suitable for storage in the freezing room. The first chamber 101 in the embodiment of the present invention is preferably a refrigerating room.

The traditional refrigerator with a composite door is prone to the problems of larger fluctuation of cryogenic temperature in a door body chamber (i.e., the second chamber in the embodiment of the invention), uneven temperature distribution of all parts in the chamber, and condensation easily occurring on a wall surface in the chamber.

In the embodiment of the present invention, the air is supplied to the second chamber 201 through the plurality of air diffusion micro-holes 218, and air supply points are numerous and wide in distribution range, so that all the parts of the second chamber 201 can be directly covered by the cold air. Even if some of the air diffusion micro-holes 218 are blocked by stored articles, the other air diffusion micro-holes 218 can continue to supply air, which makes the refrigeration process of the second chamber 201 not affected by the blockage of the stored articles. Therefore, the temperature of all the parts of the second chamber 201 is more uniform in the embodiment of the present invention.

In addition, the embodiment of the present invention uses the air duct 215 to supply air to the second chamber 201, and can control the flow rate of the air duct 215 by detecting the temperature of the second chamber 201 in real time, so that the temperature of the second chamber 201 is more accurately maintained at a set level, and the temperature fluctuation in the second chamber 201 is accordingly reduced, which is conducive to the long-term preservation of stored articles.

Further, the inventor realized that since the rear wall 211 of the main door 210 directly faces the first chamber 101, the temperature of the rear wall is lower than those of other parts of the main door 210, and condensation is more likely to occur. Therefore, the refrigerator according to the embodiment of the present invention supplies the air to the second chamber 201 through the air diffusion micro-holes 218, so that there is a stronger air flow flowing near the rear wall 211 of the main door 210, the flowing of the air flow will inhibit the condensation process on the front surface of the rear wall 211 of the main door 210, and it is difficult to generate condensed dew. Furthermore, the relative humidity of the air flow entering the second chamber 201 from the air duct 215 is inevitably lower than that of the original air flow at the front surface of the rear wall 211 of the main door 210 (the relative humidity of the air near the condensed dew is inevitably very high), so the introduction of the low-humidity air of the air duct 215 can promote the evaporation of the condensed dew. In addition, since the plurality of air diffusion micro-holes 218 are formed in the front surface of the rear wall 211 of the main door 210, the surface area of a physical part of the rear wall is significantly smaller and separated by the air diffusion micro-holes 218, which is even more unfavorable for the generation and retention of the condensed dew.

The refrigerator according to the embodiment of the present invention does not employ the traditional methods such as electrically heating the rear wall 211 or introducing hot air, but still utilizes the cold air of the first chamber 101 to remove dew, and a dew removal process basically does not affect the normal refrigeration for the second chamber 201, so that the structural design is very ingenious.

In some embodiments, as shown in FIGS. 1 to 3, an air inlet 212 of the air duct 215 faces the first chamber 101, so as to introduce the cold air in the first chamber 101. Since the cold air in the first chamber 101 opposite to the main door 210 is directly utilized, it is more convenient, and the overall structure of the refrigerator is simpler.

In some alternative embodiments, cold air can also be directly introduced from a cold source (such as a cooling room) of the refrigerator to obtain purer cold air, for example, guided by an air guide pipe. The specific structure will not be repeated here.

In some embodiments, as shown in FIGS. 1 to 3, the rear wall 211 of the main door 210 is also provided with an air return port 214 communicated with the first chamber 101 and the second chamber 201 to allow the air in the second chamber 201 to return to the first chamber 101 through the air return port 214. Further, the air inlet 212 and the air return port 214 are located at a top and a bottom of the rear wall 211, respectively. After entering the air duct 215 from the air inlet 212, the cold air has a sinking effect due to its relatively high density, and will flow downward more smoothly. Moreover, since the air return port 214 is formed in the bottom, a return air flow (with relatively high temperature) coming from the second chamber 201 flows upward from the bottom of the first chamber 101 to be cooled by the first chamber 101, thus recovering to a lower temperature more quickly.

In some embodiments, as shown in FIGS. 2 to 4, the refrigerator further includes a fan 230. The fan 230 is installed at the air inlet 212 to promote the air in the first chamber 101 to flow into the air duct 215. In this way, the forced circulation of the air flow can be realized by means of the fan 230, so that the refrigeration speed of the second chamber 201 is accelerated.

As shown in FIG. 4, the refrigerator further includes a temperature sensor 300 and a controller 700. The temperature sensor 300 is used to detect the temperature of the second chamber 201, and the controller 700 is used to receive a detection signal of the temperature sensor 300, and control a running state of the fan 230 according to the temperature of the second chamber 201. The running state of the fan 230 includes the starting, stopping and running time of the fan 230, and the air volume of the air duct 215 is accordingly adjusted, so that the refrigerating capacity of the second chamber 201 is finally adjusted. For example, when the temperature of the second chamber 201 is lower than a set value, the fan 230 can be turned on, and the rotation speed of the fan 230 can be controlled according to a temperature difference. The greater the temperature difference, the higher the rotation speed.

The temperature sensor 300 can be installed on a top surface of the second chamber 201. Since the temperature of the top surface of the second chamber 201 is relatively high, the action of the fan 230 can be made more timely.

In some embodiments of the present invention, the arrangement density of the air diffusion micro-holes 218 is also designed. Specifically, in a direction from top to bottom, the arrangement density of the air diffusion micro-holes 218 is gradually decreased. That is, there are more holes at an upper part of the rear wall 211 of the main door 210 and fewer holes at a lower part thereof. This arrangement makes the air volume in a space at an upper side of the second chamber 201 larger, so as to compensate for the influence of the faster temperature rise of the upper side of the second chamber 201 caused by hot air floating upward, and further make the temperature throughout the second chamber 201 more uniform.

The plurality of air diffusion micro-holes 218 may also be allowed to have a plurality of different air outlet directions, so that the overall air supply of the rear wall 211 of the main door 210 is more dispersed, to make the temperature of all the parts of the second chamber 201 more uniform.

As shown in FIG. 1, the plurality of air diffusion micro-holes 218 are all circular and arranged in a matrix. The perforated area of the rear wall 211 of the main door 210 can be spread over the entire front surface of the rear wall 211, or it can be spread over part of the front surface of the rear wall 211. The perforating percentage of the air diffusion micro-holes 218 can be 10%-80%. The air diffusion micro-holes 218 may also be elliptical, square or other shaped.

Hereto, those skilled in the art should realize that although a plurality of exemplary embodiments of the present invention have been shown and described in detail herein, without departing from the spirit and scope of the present invention, many other variations or modifications that conform to the principles of the present invention can still be directly determined or deduced from the contents disclosed in the present invention. Therefore, the scope of the present invention should be understood and recognized as covering all these other variations or modifications.

What is claimed is:

1. A refrigerator, comprising a refrigerator body and a door body, wherein a front side of the refrigerator body is open to define a first chamber; the door body comprises a main door and a secondary door, the main door is used for opening and closing the first chamber and defining a second chamber, and the secondary door is used for opening and closing the second chamber, wherein a rear wall of the main door is of a hollow structure to define an air duct between a front surface and a rear surface of the rear wall, the air duct extending vertically to run through the rear wall in an up and down direction, and a plurality of air diffusion micro-holes communicated with the second chamber and the air duct and directly facing the second chamber are backwards formed in the front surface of the rear wall; and the refrigerator is configured such that cold air produced by the refrigerator is introduced into the air duct, and then is allowed to enter the second chamber from the air duct through the plurality of air diffusion micro-holes.

2. The refrigerator according to claim 1, wherein an air inlet of the air duct faces the first chamber to introduce cold air from the first chamber.

3. The refrigerator according to claim 2, wherein the rear wall is also provided with an air return port communicated with the first chamber and the second chamber to allow air in the second chamber to return to the first chamber through the air return port.

4. The refrigerator according to claim 3, wherein the air inlet and the air return port are located at a top and a bottom of the rear wall, respectively.

5. The refrigerator according to claim 2, further comprising:

a fan, installed at the air inlet to promote the air in the first chamber to flow into the air duct.

6. The refrigerator according to claim 5, further comprising:

a temperature sensor, used for detecting the temperature of the second chamber; and a controller, used for receiving a detection signal of the temperature sensor, and controlling a running state of the fan according to the temperature of the second chamber.

7. The refrigerator according to claim 6, wherein the temperature sensor is installed on a top surface of the second chamber.

8. The refrigerator according to claim 1, wherein the arrangement density of the air diffusion micro-holes gradually decreases in a direction from top to bottom.

9. The refrigerator according to claim 1, wherein the plurality of air diffusion micro-holes have a plurality of different air outlet directions.

10. The refrigerator according to claim 1, wherein the plurality of air diffusion micro-holes are all circular and arranged in a matrix.

* * * * *